US009752274B2

(12) United States Patent
Lee et al.

(10) Patent No.: US 9,752,274 B2
(45) Date of Patent: Sep. 5, 2017

(54) CLOTHES DRYER

(71) Applicant: LG ELECTRONICS INC., Seoul (KR)

(72) Inventors: Yongju Lee, Changwon-si (KR); Sangik Lee, Changwon-si (KR); Hyunwoo Noh, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/177,659

(22) Filed: Feb. 11, 2014

(65) Prior Publication Data

US 2014/0190032 A1 Jul. 10, 2014

Related U.S. Application Data

(62) Division of application No. 13/177,885, filed on Jul. 7, 2011.

(30) Foreign Application Priority Data

Jul. 8, 2010 (KR) ..... 10-2010-0065919
Jul. 8, 2010 (KR) ..... 10-2010-0065920
(Continued)

(51) Int. Cl.
*D06F 58/24* (2006.01)
*D06F 58/22* (2006.01)
*F26B 21/08* (2006.01)

(52) U.S. Cl.
CPC ..... *D06F 58/24* (2013.01); *D06F 58/22* (2013.01); *F26B 21/086* (2013.01)

(58) Field of Classification Search
CPC ..... D06F 58/24; D06F 58/22; F26B 21/086
See application file for complete search history.

(56) References Cited

U.S. PATENT DOCUMENTS 2,165,487 A * 7/1939 Johnson ..... D06F 3/00 34/87
3,940,861 A * 3/1976 Frazar ..... D06F 58/24 34/75
(Continued)

FOREIGN PATENT DOCUMENTS

DE 2006-061211 6/1922
DE 37 38 031 A1 5/1989
(Continued)

OTHER PUBLICATIONS

European Search Report dated Oct. 21, 2014 issued in Application No. 11803819.9.
(Continued)

*Primary Examiner* — Kenneth Rinehart
*Assistant Examiner* — Tavia Sullens
(74) *Attorney, Agent, or Firm* — KED & Associates LLP

(57) ABSTRACT

Disclosed is a clothes dryer including a heat exchanger for condensing air discharged from a drum to remove moisture from the air, a collector for collecting condensed water produced in the heat exchanger, a first pump for pumping the condensed water from the collector to a water tank, and a discharge unit for selectively discharging the condensed water from the water tank, to wash the heat exchanger using the condensed water.

10 Claims, 22 Drawing Sheets

(30) Foreign Application Priority Data

Jul. 8, 2010 (KR) ..... 10-2010-0065921
Jul. 8, 2010 (KR) ..... 10-2010-0065922

(56) References Cited

U.S. PATENT DOCUMENTS

| | | | | |
|---|---|---|---|---|
| 4,934,403 | A | 6/1990 | Mooney et al. | |
| 7,841,351 | B1 * | 11/2010 | Kane | B08B 3/02 134/172 |
| 2005/0278983 | A1 | 12/2005 | Rydberg | |
| 2010/0065087 | A1 | 3/2010 | Grunert | |
| 2010/0101606 | A1 | 4/2010 | Grunert | |
| 2013/0255331 | A1 * | 10/2013 | Bommels | D06F 58/24 68/5 R |
| 2013/0340797 | A1 * | 12/2013 | Bommels | D06F 58/24 134/34 |

FOREIGN PATENT DOCUMENTS

| | | | | |
|---|---|---|---|---|
| DE | 10-2006018469 | | 10/2007 | |
| DE | EP 2169107 | A1 * | 3/2010 | D06F 58/24 |
| DE | 102008054832 | A1 | 7/2010 | |
| EP | 0 535 348 | A1 | 4/1993 | |
| EP | 0 816 549 | A2 | 1/1998 | |
| EP | 2 138 627 | A1 | 12/2009 | |
| JP | 2010-057651 | A | 3/2010 | |
| KR | 10-1999-0020955 | | 3/1999 | |
| KR | 20-0155830 | | 6/1999 | |
| KR | 10-1999-0079508 | | 11/1999 | |
| KR | 10-2000-0034324 | | 6/2000 | |
| KR | 10-2005-0061876 | | 6/2005 | |
| KR | 10-0698132 | | 3/2007 | |
| KR | 10-2007-0076853 | A | 7/2007 | |
| KR | 10-2009-0028027 | | 3/2009 | |
| KR | 10-2009-0028027 | A | 3/2009 | |
| KR | 10-2010-0031926 | | 3/2010 | |
| KR | 10-2011-0059993 | A | 6/2011 | |
| WO | WO 2008/077708 | A1 | 7/2008 | |
| WO | WO 2008/119611 | A1 | 10/2008 | |
| WO | WO 2009/059874 | A1 | 5/2009 | |
| WO | WO 2009/095316 | | 8/2009 | |
| WO | WO 2010/003999 | A1 | 1/2010 | |
| WO | WO 2010/112321 | A1 | 10/2010 | |

OTHER PUBLICATIONS

Korean Notice of Allowance dated Apr. 5, 2012 issued in Application No. 10-2010-0065922 (with English Translation).
International Search Report dated Jun. 28, 2012 issued in Application No. PCT/KR2011/004989.
U.S. Office Action dated Jun. 17, 2013 issued in U.S. Appl. No. 13/177,885.
U.S. Final Office Action dated Nov. 18, 2013 issued in U.S. Appl. No. 13/177,885.
European Office Action dated Mar. 9, 2016 issued in Application No. 11803819.9.

* cited by examiner (a)

(b)

(a)

(b)

CLOTHES DRYER

CROSS-REFERENCE TO RELATED APPLICATION(S)

This application is a Divisional of application Ser. No. 13/177,885 filed on Jul. 7, 2011, which claims the benefit of Korean Patent Application Nos. 10-2010-0065919, filed on Jul. 8, 2010, 10-2010-0065920, filed on Jul. 8, 2010, 10-2010-0065921, filed on Jul. 8, 2010, 10-2010-0065922, filed on Jul. 8, 2010, which is hereby incorporated by reference as if fully set forth herein.

BACKGROUND

1. Field

The present invention relates to clothes dryer equipped with a heat exchanger, and more particularly to a clothes dryer equipped with a heat exchanger, which is capable of washing the heat exchanger using condensed water generated from the heat exchanger.

2. Discussion of the Related Art

Generally, clothes dryer have a clothes drying function, namely, a function to blow hot air into a drum defining a drying chamber, and thus to absorb moisture from an object to be dried, thereby drying the object. Such clothes dryers are mainly classified into an exhaustion type clothes dryer and a condensation type clothes dryer.

The exhaustion type clothes dryer uses a system in which humid air discharged from the drum is exhausted to the outside of the clothes driver. In this case, an exhaust duct is needed to outwardly exhaust moisture evaporated in the drum.

The condensation type clothes driver uses a re-circulation system in which humid air discharged from the drum is condensed in a heat exchanger to remove moisture from the humid air, and the resultant dry air is again supplied to the drum. In this case, it is difficult to use gas as a heat source because a closed loop of a dry air flow is formed.

In the above-mentioned condensation type clothes dryer, condensed water is generated during condensation of the humid air because the humid air discharged from the drum is condensed in the heat exchanger to remove moisture from the humid air. The condensed water is pumped by a pump to be drained to the outside of the clothes driver.

However, when the condensed water is drained using the drainage pump, as mentioned above, generation of noise and increased power consumption occur due to the driving of the drainage pump.

Furthermore, foreign matter, for example, lint, which is separated from clothes, is included in the humid air discharged from the drum. When the humid air, which includes the foreign matter, passes through the heat exchanger, in particular, an evaporator, the foreign matter adheres to the evaporator, thereby degrading the drying performance of the evaporator. In order to solve this problem, there is a conventional proposal to install a filter at an inlet through which humid air is introduced into the evaporator. In this case, however, a new problem occurs in that the flow rate of blown air is reduced due to the filter, so that a reduction in drying efficiency occurs.

SUMMARY OF THE INVENTION

Accordingly, the present invention is directed to a clothes dryer that substantially obviates one or more problems due to limitations and disadvantages of the related art.

An object of the present invention is to provide a clothes dryer of a new system capable of removing foreign matter from humid air discharged from a drum.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a clothes dryer includes a heat exchanger for condensing air discharged from a drum to remove moisture from the air, a collector for collecting condensed water produced in the heat exchanger, a first pump for pumping the condensed water from the collector to a water tank, and a discharge unit for selectively discharging the condensed water from the water tank, to wash the heat exchanger using the condensed water.

The discharge unit may include a valve unit for discharging the condensed water from the water tank into a discharge line, and an actuator for selectively opening or closing the valve unit.

The actuator may include a solenoid switch operating using an electromagnetic force.

The clothes dryer may further include a return unit for returning the valve unit to an original state.

The return unit may include a housing defining an outer appearance of the return unit, a connector connected to the valve unit and disposed in the housing, to be vertically movable, and an elastic member coupled to the connector, to return the connector to an original position.

The return unit may further include a support member for fixing the housing.

The actuator may vertically move the valve unit in accordance with the operation of the solenoid switch. The actuator may include a lever for performing a seesaw motion in accordance with the operation of the solenoid switch, thereby vertically moving the valve unit.

The actuator may include a lifter arranged on an outer peripheral edge of the discharge line, which communicates with the water tank, the lifter functioning to vertically move the valve unit, and a lever for performing a seesaw motion in accordance with the operation of the solenoid switch, thereby vertically moving the lifter.

The discharge line may have at least one bent portion. The actuator may be disposed at the bent portion of the discharge line.

In particular, the bent portion of the discharge line may have a stepped structure.

The discharge line may be formed with a cut-out portion. The valve unit may be selectively inserted into the cut-out portion.

The valve unit may have a size corresponding to an inner diameter of the cut-out portion.

The valve unit may be hingably coupled to the discharge line. The actuator may include a wire connected to the valve unit to lift the valve unit.

The valve unit may include first and second rotating plugs coupled to each other to be rotated with respect to each other, each of the first and second rotating plugs having at least one discharge hole and at least one shield portion. The actuator may rotate at least one of the first and second rotating plugs to align the discharge holes of the first and second rotating plugs, thereby allowing discharge of the condensed water through the first and second rotating plugs.

The return unit may include a spiral spring for returning the first and second rotating plugs to original states thereof.

The actuator may include an electromagnet for establishing a magnetic field when power is applied to the electromagnet.

The valve unit may be made of a magnetic material. The actuator may selectively open or close the valve unit using an electromagnetic force.

The discharge unit may further include a housing defining an outer appearance of the discharge unit, and a support member for supporting the housing, a connector made of a magnetic material and connected to the valve unit, the connector being vertically movable within the housing, and an elastic member connected to the connector, to return the connector to an original position. The actuator may include an electromagnet for selectively moving the connector, to cause the condensed water to be discharged from the water tank into the discharge line.

The electromagnet may be disposed over the valve unit.

The electromagnet may be disposed on a top wall of the water tank.

The actuator may include a motor for supplying a rotating force.

The valve unit may include a drainage bolt arranged at a bottom wall of the water tank. The actuator may further include a rotating gear for rotating the drainage bolt in accordance with a rotation of the motor.

The valve unit may include first and second rotating plugs arranged at the discharge line and coupled to each other to be rotated with respect to each other. Each of the first and second rotating plugs may have at least one discharge hole and at least one shield portion. The actuator may rotate at least one of the first and second rotating plugs in accordance with a rotation of the motor, to align the discharge holes of the first and second rotating plugs, thereby allowing discharge of the condensed water through the first and second rotating plugs.

The valve unit may include a plate rotatably mounted to the discharge line. The actuator may rotate the plate in accordance with a rotation of the motor, to allow discharge of the condensed water.

The plate may have a size corresponding to an inner diameter of the discharge line.

The valve unit may further include a rubber sealing member arranged at an outer peripheral edge of the plate.

The discharge unit may further include a return unit for returning the valve unit to an original state. The actuator may include a cam for vertically moving the valve unit in accordance with a rotation of the motor.

The water tank may include a filter unit for filtering out lint included in the condensed water. The filter unit may be separably mounted to the water tank.

The filter unit may include a body opened at one side thereof, and a filter arranged at the body.

The filter may be arranged on at least one of side and bottom sides of the body.

The filter unit may be arranged at a top of the water tank.

The discharge unit may include a second pump for supplying the condensed water from the water tank to the heat exchanger, to wash the heat exchanger by the supplied condensed water.

The discharge unit may include a valve for selectively opening and closing an outlet of the water tank, through which the condensed water is discharged.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Reference will now be made in detail to the preferred embodiments of the present invention associated with a clothes dryer, examples of which are illustrated in the accompanying drawings.

Figure 1:
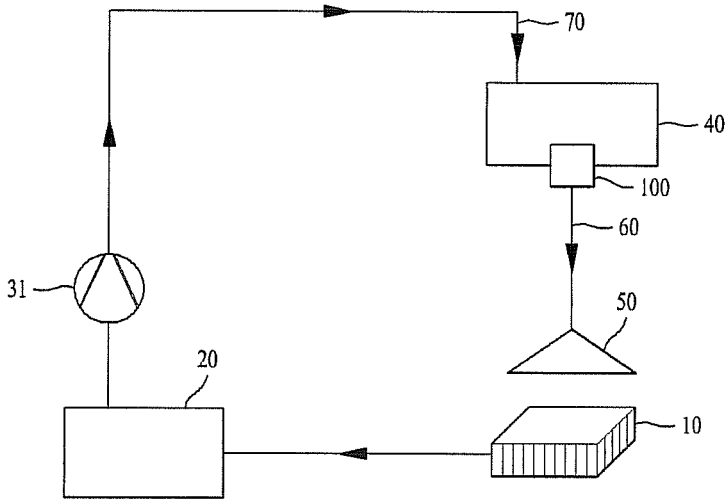
FIG. 1 is a schematic view illustrating a clothes dryer according to an exemplary embodiment of the present invention.

FIG. 1 is a schematic view illustrating a clothes dryer according to an exemplary embodiment of the present invention.

The clothes dryer according the illustrated embodiment of the present invention includes a heat exchanger 10 for condensing air discharged from a drum 1 (FIG. 18) to remove moisture from the air. The clothes dryer also includes a collector 20 for collecting condensed water generated when the air discharged from the drum 1 passes through the heat exchanger 10. The clothes dryer further includes a first pump 31 for pumping the condensed water from the collector 20 to a water tank 40. The clothes dryer further includes a discharge unit 100 for discharging the condensed water from the water tank 40 into a discharge line 60, to wash the heat exchanger 10 by the condensed water.

The heat exchanger 10 may be implemented by devices of various types. Preferably, the heat exchanger 10 is implemented by a heat pump. Dry air introduced into the drum via a circulation duct (not shown) absorbs moisture from an object to be dried, so that it is discharged in a humid state from the drum. The humid air discharged from the drum passes through the heat pump. At this time, the humid air is condensed to remove moisture therefrom, and then heated. As the humid air passes through the heat pump, it condensed to remove moisture therefrom, thereby producing dry air. Condensed water produced during condensation of moisture flows downwards from the heat pump. The condensed water is then collected in the collector 20 disposed beneath the heat pump.

The first pump 31 pumps the condensed water collected in the collector 20 to the water tank 40 via a supply line 70. The first pump 31 may be disposed at a lower portion of the clothes dryer. Preferably, the first pump 31 is disposed near the collector 20.

The water tank 40 receives the condensed water pumped by the first pump 31. The amount of condensed water collected in the collector 20 after the clothes dryer operates once is insufficient to wash the heat exchanger 10. To this end, the water tank 40 is provided to reserve a minimum amount of condensed water required to wash the heat exchanger 10 once. The water tank 40 is connected, at a top thereof, to the supply line 70 while being connected, at a bottom thereof, to the discharge line 60. The water tank 40 may be disposed over the heat exchanger 10. Preferably, the water tank 40 is disposed at an upper portion of the clothes dryer. That is, when it is desired to wash the heat exchanger 10 through natural falling of the condensed water received in the water tank 40, it is necessary to generate certain water pressure. To this end, the water tank 40 is disposed over the heat exchanger 10, in particular, at an upper portion the clothes dryer, in order to enable the condensed water to have certain potential energy, and thus to generate certain water pressure. Thus, when the condensed water, which has certain potential energy, is discharged from the water tank 40 to the discharge line 60, the potential energy is converted into kinetic energy.

Meanwhile, the discharge unit 100 selectively discharges the condensed water from the water tank 40 into the discharge line 60. When a minimum amount of condensed water required to wash the heat exchanger 10 is collected in the water tank 40, the discharge unit 100 discharges the collected condensed water into the discharge line 60, in order to wash the heat exchanger 10.

The discharge unit 100 includes a valve unit 110, 210, 310, 410, 510, or 610 for selectively discharging the condensed water from the water tank 40 into the discharge line 60. The discharge unit 100 also includes an actuator 150, 250, 350, 550, or 650 for selectively opening or closing the valve unit 110, 210, 310, 410, 510, or 610. The actuator 150, 250, 350, 550, or 650 may be constituted by a solenoid switch, an electromagnet, or a motor. The discharge unit 100 further includes a washing member 50 for injecting condensed water onto the heat exchanger 10. The solenoid switch, which is designated by reference numeral 152 or 252, is a switch operating using electromagnetic force generated when power is applied thereto.

Figure 2:
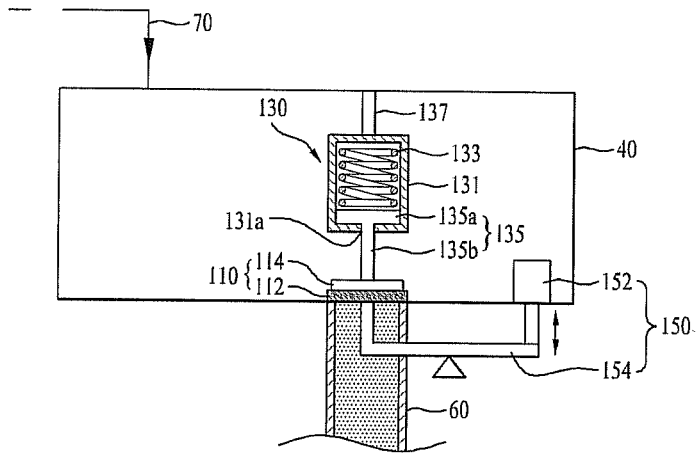
FIG. 2 is a view illustrating a configuration of a discharge unit included in the clothes dryer in accordance with a first embodiment of the present invention.
Figure 2:
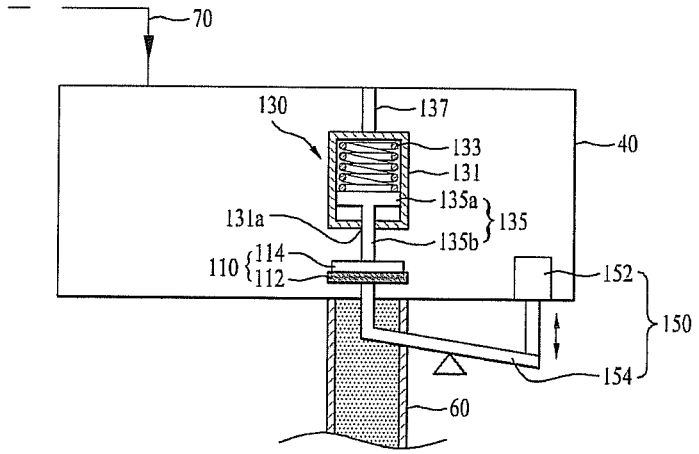

FIG. 2 is a view illustrating a configuration of the discharge unit 100 in the clothes dryer according to a first embodiment of the present invention. FIG. 2(*a*) illustrates a closed state of the discharge line, whereas FIG. 2(*b*) illustrates an opened state of the discharge line.

The discharge unit 100 of the clothes dryer according to the first embodiment of the present invention includes the valve unit 110, the actuator 150, and a return unit 130.

The valve unit 110 functions to selectively discharge the condensed water from the water tank 40 into the discharge line 60. The valve unit 110 includes a plug 114 to selectively open or close the discharge line 60. The plug 114 may be arranged at a point where the discharge line 60 is connected to the water tank 40. The plug 114 may have a plate shape. Preferably, the plug 114 has a larger diameter than the inner diameter of the discharge line 60. A sealing member 112 may be provided at the plug 114 in order to prevent condensed water from leaking into the discharge line 60 in a state in which the plug 114 closes the discharge line 60.

The actuator 150 functions to upwardly move the valve unit 110, and thus to allow condensed water to be discharged into the discharge line 60. The actuator 150 includes the solenoid switch 152, and a lever 154 performing a seesaw motion in accordance with operation of the solenoid switch 152. The lever 154 is connected at one end thereof to a lower surface of the valve unit 110 while being connected at the other end thereof to the solenoid switch 152. The solenoid switch 152, which is connected to the other end of the lever 154, downwardly moves the other end of the lever 154. Hereinafter, operation of the actuator 150 will be described. When power is applied to the solenoid switch 152, the solenoid switch 152 downwardly moves the other end of the lever 154. At this time, one end of the lever 154 moves in a direction opposite to the movement direction of the other end of the lever 154 to which the solenoid switch 152 is connected, namely, in an upward direction. Accordingly, the valve unit 110 connected to one end of the lever 154 is upwardly moved, so that the discharge line 60 is opened. As a result, the condensed water collected in the water tank 40 is discharged through the opened discharge line 60.

The return unit 130 functions to return the valve unit 110 to an original state. That is, the return unit 130 downwardly moves the valve unit 110, which has been upwardly moved in accordance with operation of the actuator 150, thereby closing the opened discharge line 60. The solenoid switch 152, which downwardly moves the lever 154 by electromagnetic force, does not function to return the lever 154 to the original state. For this reason, the return unit 130 is provided.

The return unit 130 includes a housing 131, a connector 135, an elastic member 133, and a support member 137. The housing 131 defines an external appearance of the return unit 130, and accommodates the connector 135 and elastic member 133. The housing 131 has a cylindrical shape. The housing 131 is provided with a hole 131*a* formed through a bottom wall of the housing 131. The connector 135 extends through the hole 131*a*, to be connected to the valve unit 110. In detail, the connector 135 includes a disc 135*a* disposed in the housing 131, to move vertically, and a connecting rod 135*b* for connecting the disc 135*a* to the valve unit 110. The disc 135*a* functions to transmit elastic force from the elastic member 133 to the connecting rod 135*b*. The disc 135*a* is disposed beneath the elastic member 133 within the housing 131. Preferably, the disk 135*a* is designed to have a diameter corresponding to the inner diameter of the housing 131. When the disk 135*a* has a diameter corresponding to the inner diameter of the housing 131, it may be possible to prevent the elastic member 133 from being exposed to condensed water, and thus being corroded. The connecting rod 135*b* connects the disc 135*a* and valve unit 110, to transmit movement between the valve unit 110 and the disc 135*a*. The connecting rod 135*b* is connected at one end thereof to the lower surface of the disc 135*a* while being connected at the other end thereof to an upper surface of the valve unit 110. In addition, one end of the connecting rod 135*b* extends through the hole 131*a* formed at the bottom of the housing 131, to be connected to the lower surface of the disc 135*a*.

The elastic member 133 functions to return the valve unit 110 to an original position when power supplied to the solenoid switch 152 is cut off. For the elastic member 133, any member may be used as long as it has elastic force. Preferably, the elastic member 133 is a coil spring. The elastic member 133 is disposed in the housing 131. In detail, the elastic member 133 is arranged between the inner surface of a top wall of the housing 131 and the disc 135*a*. The elastic member 133 is compressed by the disc 135*a* when the valve unit 110 is upwardly moved in accordance with application of power to the solenoid switch 152. On the other hand, when supply of power to the solenoid switch 152 is cut off, the elastic member 133 returns to an original state thereof while downwardly pressing the disc 135*a*, thereby returning the valve unit 110 to an original position thereof. That is, the compressed elastic member 133 downwardly presses the disc 135*a* while returning to the original state thereof, thereby closing the opened discharge line 60.

The support member 137 functions to fix the housing 131. In order to fix the housing 131, the support member 137 may be coupled to one side of the housing 131. Preferably, the support member 137 is connected at one end thereof to the top wall of the housing 131 while being connected at the other end thereof to the inner surface of a top wall of the water tank 40.

Figure 3:
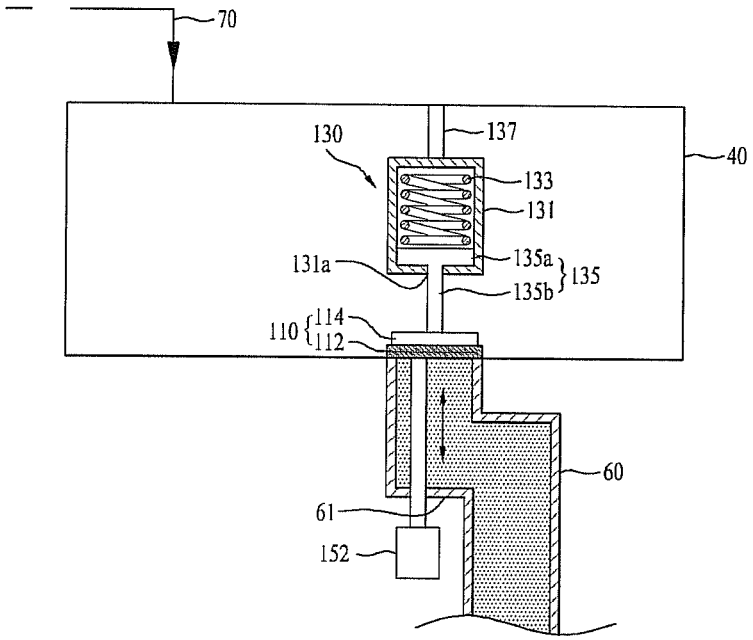
FIG. 3 is a view illustrating a modified example of the clothes dryer according to the first embodiment.

Meanwhile, the discharge line 60 may have a bent portion 61, as shown in FIG. 3. In this case, the solenoid switch 152 is preferably disposed at the bent portion 61 of the discharge line 60. Preferably, the bent portion 61 of the discharge line 60 is formed to have a stepped structure. Where the discharge line 60 has the bent portion 61, and the solenoid switch 152 is disposed at the bent portion 61, as shown in FIG. 3, the solenoid switch 152 may directly move the valve unit 110 in the upward direction without using the lever 154. The remaining configurations and operations are identical to those of FIG. 2.

Hereinafter, a configuration of the discharge unit according to a second embodiment of the present invention will be described with reference to FIG. 4. Configurations and functions identical to those of the discharge unit according to the first embodiment are omitted and, as such, the following description will be given only in conjunction with configurations and functions different than those of the discharge unit according to the first embodiment.

Figure 4:
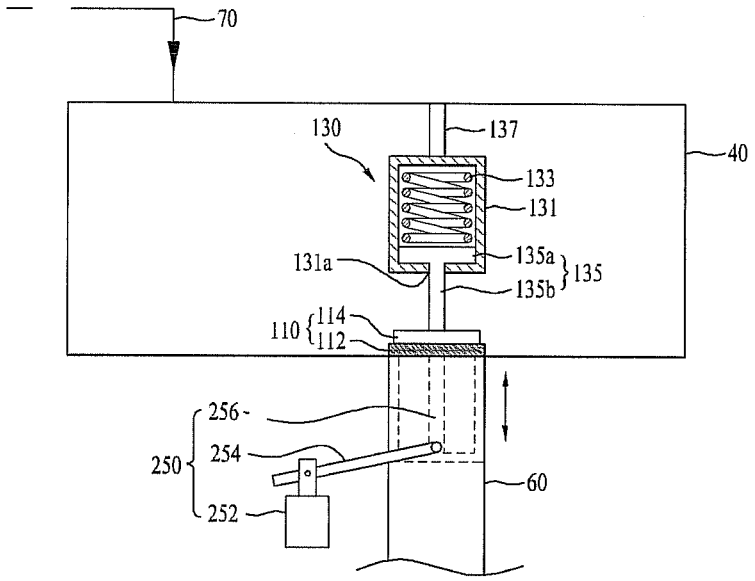
FIG. 4 is a view illustrating a configuration of the discharged unit in the clothes dryer according to a second embodiment of the present invention.
Figure 4:
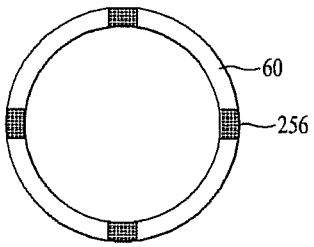

FIG. 4(*a*) is a view illustrating the configuration of the discharge unit according to the second embodiment. FIG. 4(*b*) is a sectional view illustrating the discharge line and a lifter.

The configurations and functions of the valve unit 110 and return unit 130 included in the discharge unit according to the second embodiment are identical to those of the first embodiment. The discharge unit according to the second embodiment includes the actuator 250. The actuator 250 includes a lifter 256 arranged on an outer peripheral edge of the discharge line 60 and a lever 254 for vertically moving the lifter 256, in addition to the solenoid switch 252. The lifter 256 is arranged on the outer peripheral edge of the discharge line 60, to upwardly move the valve unit 110. The lifter 256 includes a plurality of legs coupled to the outer peripheral edge of the discharge line 60. The legs are connected at a lower end of the lifter 256. The lever 254 is connected at one end thereof to one side of the lifter 256, to upwardly move the lifter 256 while performing a seesaw motion. The solenoid switch 252 is coupled to the other side of the lever 254, to downwardly move the other end of the lever 254. In this case, one end of the lever 254 is upwardly moved, thereby upwardly moving the lifter 256.

Figure 5:
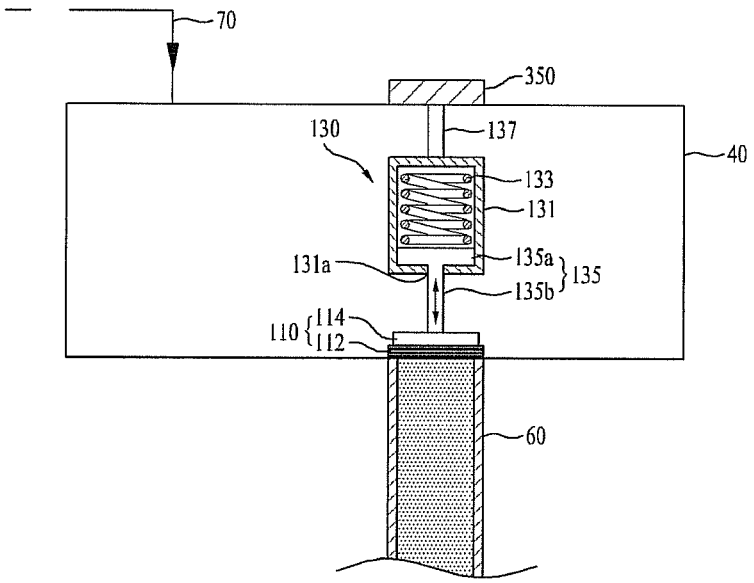
FIG. 5 is a view illustrating a configuration of the discharged unit in the clothes dryer according to a third embodiment of the present invention.

Hereinafter, a configuration of the discharge unit according to a third embodiment of the present invention will be described with reference to FIG. 5. Configurations and functions identical to those of the discharge unit according to the first embodiment are omitted and, as such, the following description will be given only in conjunction with configurations and functions different than those of the discharge unit according to the first embodiment.

The actuator of the discharge unit according to the third embodiment, which is designated by reference numeral 350, is constituted by an electromagnet. In this case, the connector 135 of the return unit 130 is constituted by a permanent magnet. Accordingly, when power is applied to the electromagnet 350, thereby establishing a magnetic field, the valve unit 110 is upwardly moved by attraction generated between the electromagnet 350 and the connector 135, thereby opening the discharge line 60. On the other hand, when supply of power to the electromagnet 350 is cut off, the elastic member 133 of the return unit 130, namely, a coil spring, downwardly moves the valve unit 110 while returning to the original state thereof. Thus, the valve unit 110 closes the discharge line 60. The electromagnet 350 is disposed on a top wall of the connector 135. Preferably, the electromagnet 350 is disposed on an outer surface of the top wall of the water tank 40. Although the connector 135 has been described as being constituted by a permanent magnet in this embodiment, the same function as described above may be obtained even when the valve unit 110 is constituted by a permanent magnet. That is, the same function as described above may be obtained as long as any one of the constituent elements functioning to upwardly move the valve unit 110 is constituted by a permanent magnet.

Figure 6:
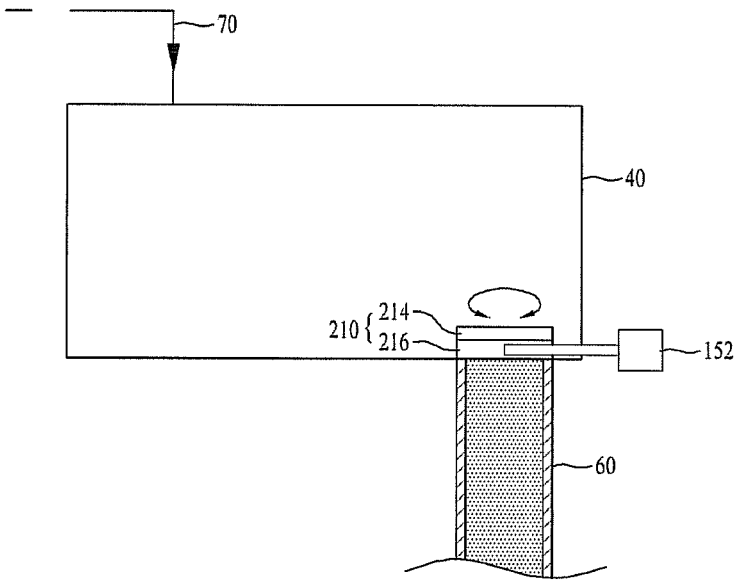
FIG. 6 is a view illustrating a configuration of the discharged unit in the clothes dryer according to a fourth embodiment of the present invention.

Hereinafter, a configuration of the discharge unit according to a fourth embodiment of the present invention will be described with reference to FIGS. 6 and 7. Configurations and functions identical to those of the discharge unit according to the first embodiment are omitted and, as such, the following description will be given only in conjunction with configurations and functions different than those of the discharge unit according to the first embodiment.

The discharge unit according to the fourth embodiment includes the valve unit 210. The valve unit 210 includes a first rotating plug 216 and a second rotating plug 214. The valve unit 210 also includes a spiral spring (not shown) for returning the first rotating plug 216 to an original state thereof. The first and second rotating plugs 216 and 214 are arranged at a point where the discharge line 60 and water tank 40 are coupled. The first and second rotating plugs 216 and 214 are arranged in a vertically stacked state.

Figure 7:
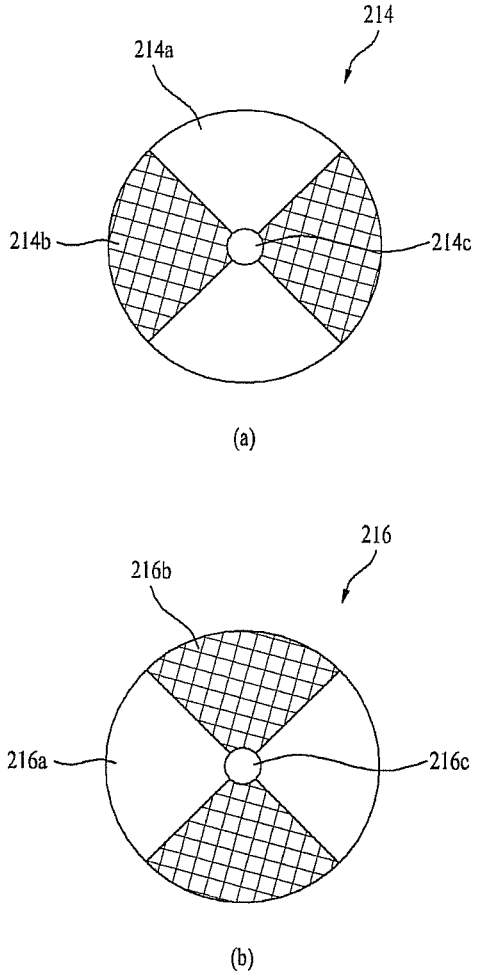
FIG. 7 is a view illustrating first and second rotating plugs included in the clothes dryer according to the fourth embodiment.

FIG. 7(*b*) is a plan view of the first rotating plug 216, whereas FIG. 7(*a*) is a plan view of the second rotating plug 214. Referring to FIG. 7(*b*), the first rotating plug 216 includes at least one discharge hole 216*a* and at least one shield portion 216*b*. The discharge hole 216*a* and shield portion 216*b* are arranged adjacent to each other. A coupling hole 26*c* is formed at a central portion of the first rotating plug 216. The second rotating plug 214 has the same configuration as the first rotating plug 216. A rotating shaft is fitted through the coupling hole 216*c* and coupling hole 214*c*, so that it is coupled with the first rotating plug 216 and second rotating plug 214.

In a state in which the valve unit 210 closes the discharge line 60, the shield portion 216*b* of the first rotating plug 216 is aligned with the discharge hole 214*a* of the second rotating plug 214. On the other hand, in a state in which the valve unit 210 opens the discharge line 60, the discharge hole 216*a* of the first rotating plug 216 is aligned with the discharge hole 214*a* of the second rotating plug 214.

Hereinafter, operation of the valve unit 210 according to the fourth embodiment will be described with reference to FIGS. 6 and 7. The solenoid switch 152 is connected to one side of the first rotating plug 216. When power is applied to the solenoid switch 152, the solenoid switch 152 rotates the first rotating plug 216 by a predetermined angle. As a result, the discharge hole 216*a* of the first rotating plug 216 is vertically aligned with the discharge hole 214*a* of the second rotating plug 214. Accordingly, condensed water is discharged from the water tank 40 into the discharge line 60 through the discharge holes 216*a* and 214*a*. When discharge of condensed water is completed, supply of power to the solenoid switch 152 is cut off. At this time, the first rotating plug 216 is rotated by a predetermined angle by the return force of the spiral spring. Accordingly, the discharge hole 216*a* of the first rotating plug 216 is aligned with the shield portion 214*b* of the second rotating plug 214. As a result, the discharge line 60 is closed.

Although the solenoid switch 152 has been described as being connected to the first rotating plug 216, it may be connected to the second rotating plug 214.

Hereinafter, a configuration of the discharge unit according to a fifth embodiment of the present invention will be described with reference to FIG. 8. Configurations and functions identical to those of the discharge unit according to the first embodiment are omitted and, as such, the following description will be given only in conjunction with configurations and functions different than those of the discharge unit according to the first embodiment.

The valve unit 110 according to the fifth embodiment is coupled to an upper end of the discharge line 60 by a hinge (not shown). Accordingly, the valve unit 110 opens or closes while rotating about the hinge. The actuator according to the fifth embodiment includes a wire 454 connected to the valve unit 110 and a pulley 456 for changing a movement direction of the wire 454. The actuator also includes the solenoid switch 152, which is configured to pull the wire 454. The wire 454 is connected at one end thereof to an upper surface of the valve unit 110 while being connected at the other end thereof to the solenoid switch 152. Accordingly, when power is applied to the solenoid switch 152, the solenoid switch 152 pulls the wire 454, thereby rotating the valve unit 110 about the hinge. As a result, the discharge line 60 is opened. When condensed water is completely discharged into the opened discharge line 60, the valve unit 110 closes the discharge line 60 by gravity. The pulley 456 is connected to an intermediate portion of the wire 454, to change the movement direction of the wire 454. One or more pulleys 456 may be provided.

In the fifth embodiment, a separate return unit 130 is unnecessary because the discharge line 60, which has been opened, is automatically closed by the weight of the valve unit 110.

Figure 8:
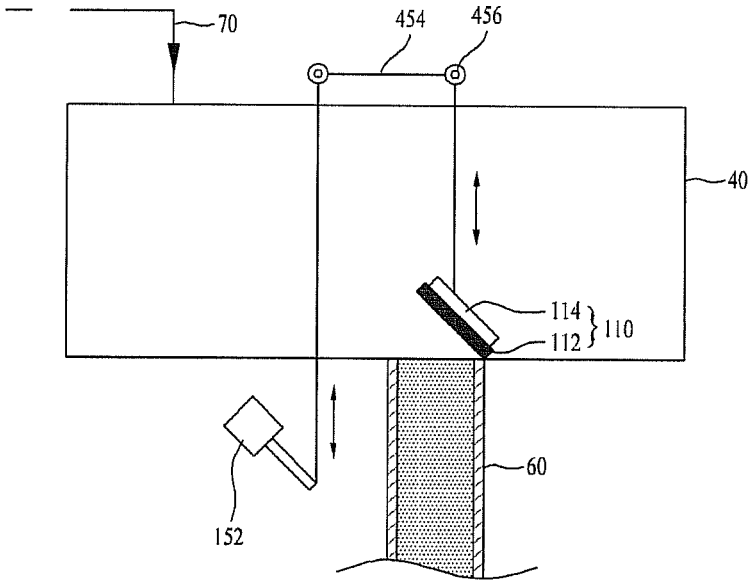
FIG. 8 is a view illustrating a configuration of the discharged unit in the clothes dryer according to a fifth embodiment of the present invention.

FIG. 8 illustrates the embodiment in which the solenoid switch 152 is disposed at the bottom wall of the water tank 40, and two pulleys 456 are arranged at an intermediate portion of the wire 454 to change the movement direction of the wire 454. However, other configurations may be implemented in accordance with the use environment of the solenoid switch 152. For example, where the solenoid switch 152 is disposed at the top wall or side wall of the water tank 40, the number of times the movement direction of the wire 454 is changed and the number of pulleys 456 may be varied.

Hereinafter, a configuration of the discharge unit according to a sixth embodiment of the present invention will be described with reference to FIGS. 9 and 10. Configurations and functions identical to those of the discharge unit according to the first embodiment are omitted and, as such, the following description will be given only in conjunction with configurations and functions different than those of the discharge unit according to the first embodiment.

Figure 9:
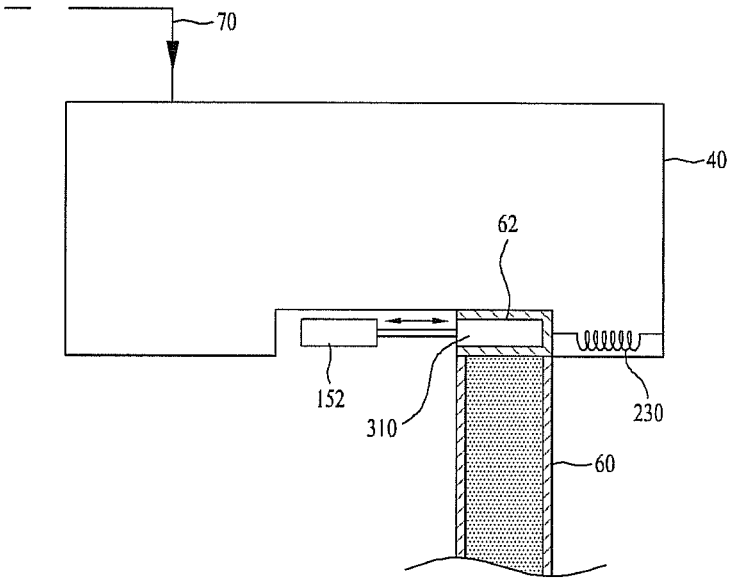
FIGS. 9 and 10 are views illustrating a configuration of the discharged unit in the clothes dryer according to a sixth embodiment of the present invention.
Figure 10:
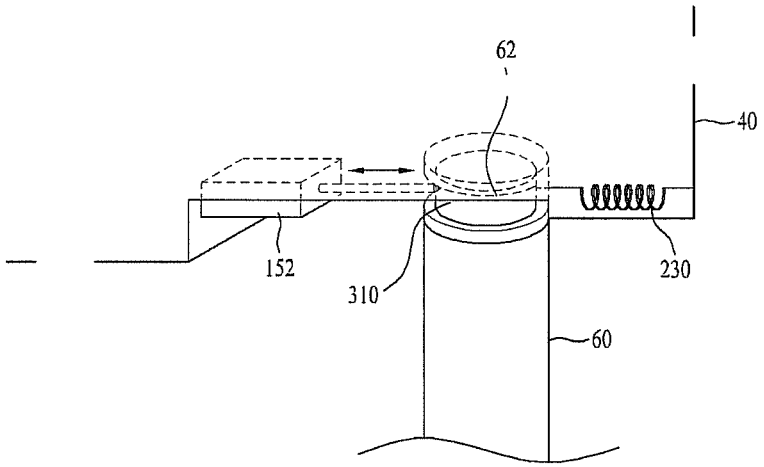

Referring to FIGS. 9 and 10, the discharge unit according to the sixth embodiment includes a cut-out portion 62 formed at a portion of the discharge line 60. The cut-out portion 62 is preferably arranged at an upper portion of the discharge line 60 although it may be arranged at any portion of the discharge line 60.

The valve unit 310 is selectively inserted into or extracted from the cut-out portion 6, to close or open the discharge line 60. When the valve unit 310 is inserted into the cut-out portion 62, the discharge line 60 is closed, thereby preventing condensed water from being discharged from the water tank 40 into the discharge line 60. Preferably, the valve unit 310 is designed to have a diameter corresponding to the inner diameter of the cut-out portion 62, in order to prevent condensed water from leaking into the discharge line 60 in a state in which the valve unit 110 is inserted into the cut-out portion 62. When the valve unit 310 is extracted from the cut-out portion 62, the discharge line 60 is opened. In this state, condensed water is discharged from the water tank 40 into the discharge line 60. The actuator includes the solenoid switch 152. The solenoid switch 152 is connected to one side of the valve unit 310. In accordance with operation of the solenoid switch 152, the valve unit 310 is extracted from the cut-out portion 62. The return unit 230 is connected to the other side of the valve unit 310, to again insert the valve unit 310 into the cut-out portion 62. Preferably, the return unit 230 is a coil spring. The spring 230 is fixedly coupled, at one side, to the other side of the valve unit 310 while being fixedly coupled, at the other side, to the inner surface of the water tank 40. In accordance with this configuration, the valve unit 310 is extracted from the cut-out portion 6 when the solenoid switch 152 operates, thereby discharging condensed water from the water tank 40. When supply of power to the solenoid switch 152 is cut off, the valve unit 310 is inserted into the cut-out portion 62 by the return force of the spring 230, thereby closing the discharge line 60.

Figure 11:
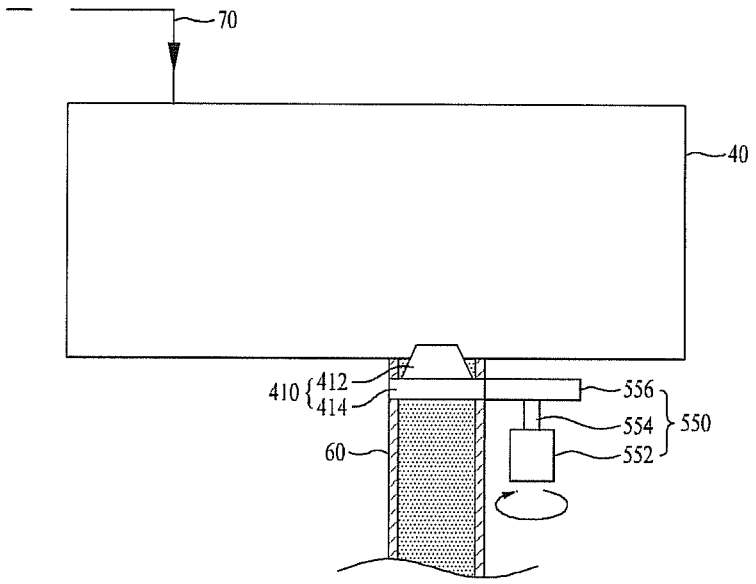
FIG. 11 is a view illustrating a configuration of the discharged unit in the clothes dryer according to a seventh embodiment of the present invention.

Hereinafter, a configuration of the discharge unit according to a seventh embodiment of the present invention will be described with reference to FIG. 11. Configurations and functions identical to those of the discharge unit according to the first embodiment are omitted and, as such, the following description will be given only in conjunction with configurations and functions different than those of the discharge unit according to the first embodiment.

The discharge unit of the clothes dryer according to the seventh embodiment of the present invention includes the valve unit 410 and the actuator 550.

The valve unit 410 is configured to discharge condensed water from the water tank into the discharge line 60. In this embodiment, the valve unit 410 may also be referred to as a drainage bolt 410 for selectively opening or closing the discharge line 60. The drainage bolt 410 is arranged at the discharge line 60. The drainage bolt 410 includes a threaded portion 412 threaded to the water tank 40 and a head 414 connected to a lower end of the threaded portion 412. The threaded portion 412 is threaded to the bottom wall of the water tank 40. The head 414 is provided at the lower end of the threaded portion 412. Teeth are formed at an outer peripheral surface of the head 414.

The actuator 550 rotates the drainage bolt 410 to allow condensed water to be discharged into the discharge line 60. The actuator 550 includes a motor 552, a rotating shaft 554 connected to the motor 552, and a rotating gear 556 connected to the rotating shaft 554. The motor 552 rotates in a normal direction or a reverse direction in accordance with the application direction of power to the motor 552. The rotating shaft 554 is coupled between the motor 552 and the rotating gear 556, to transmit rotating force from the motor 552 to the rotating gear 556. As described above, teeth are formed at the outer peripheral surface of the rotating gear 556. In accordance with rotation of the motor 552, the rotating gear 556 is rotated in a normal direction or in a reverse direction. The rotating gear 556 is engaged with the head 414 of the drainage bolt 410.

Hereinafter, operation of the discharge unit according to the seventh embodiment will be described. When the motor 552 rotates, the rotating gear 556 is rotated in the same direction as the motor 552. Accordingly, the drainage bolt 410, which is engaged with the rotating gear 556, is rotated in a direction reverse to the rotation direction of the rotating gear 556. As a result, the discharge line 60 is opened. When condensed water is completely discharged from the water tank 40 into the discharge line 60, the motor 552 rotates reversely, so that the rotating gear 556 is reversely rotated. Accordingly, the drainage bolt 410 is rotated in a direction reverse to the rotation direction of the rotating gear 556. As a result, the drainage bolt 410 closes the discharge line 60.

Figure 12:
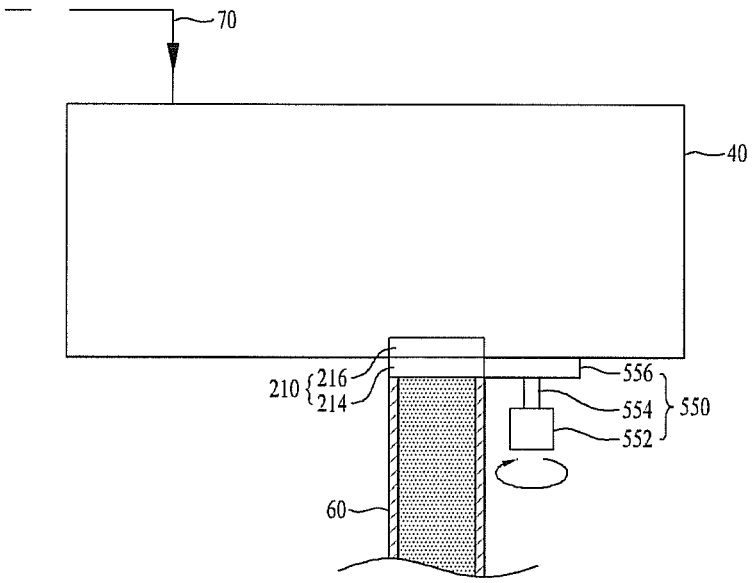
FIG. 12 is a view illustrating a configuration of the discharged unit in the clothes dryer according to an eighth embodiment of the present invention.

Hereinafter, a configuration of the discharge unit according to an eighth embodiment of the present invention will be described with reference to FIGS. 12 and 7. The valve unit used in the embodiment of FIG. 12 uses the same system as the embodiment of FIG. 7. Configurations and functions identical to those of the discharge units according to the previous embodiments are omitted and, as such, the following description will be given only in conjunction with configurations and functions different than those of the discharge units according to the previous embodiments.

The valve unit 210 of the discharge unit according to the eighth embodiment includes a first rotating plug 216 and a second rotating plug 214. The first and second rotating plugs 216 and 214 are arranged at a point where the discharge line 60 and water tank 40 are coupled. The first and second rotating plugs 216 and 214 are arranged in a vertically stacked state. Teeth are formed at an outer peripheral edge of the first rotating plug 216. The first rotating plug 216 is engaged with the rotating gear 556.

In a state in which the valve unit 210 closes the discharge line 60, the shield portion **216*b* of the first rotating plug 216 is aligned with the discharge hole 214*a* of the second rotating plug 214. On the other hand, in a state in which the valve unit 210 opens the discharge line 60, the discharge hole 216*a* of the first rotating plug 216 is aligned with the discharge hole 214*a* of the second rotating plug 214**.

Hereinafter, operation of the valve unit 210 according to the eighth embodiment will be described. The rotating gear 556 is connected to one side of the second rotating plug 214. When power is applied to the motor 552, the motor 552 and rotating gear 556 rotate in a normal direction, thereby rotating the second rotating plug 214 by a predetermined angle. As a result, the discharge hole **214*a* of the second rotating plug 214 is vertically aligned with the discharge hole 216*a* of the first rotating plug 216. Accordingly, condensed water is discharged from the water tank 40 into the discharge line 60 through the discharge holes 214*a* and 216*a*. When discharge of condensed water is completed, the motor 552 and rotating gear 556 rotate in a reverse direction. At this time, the second rotating plug 214, which is engaged with the rotating gear 556, is reversely rotated by a predetermined angle. Accordingly, the discharge hole 214*a* of the second rotating plug 214 is aligned with the shield portion 216*b* of the first rotating plug 216. As a result, the discharge line 60** is closed.

Although the rotating gear 556 has been described as being connected to the second rotating plug 214, it may be connected to the first rotating plug 216.

Hereinafter, a configuration of the discharge unit according to a ninth embodiment of the present invention will be described with reference to FIGS. 13 and 14. Configurations and functions identical to those of the discharge units according to the previous embodiments are omitted and, as such, the following description will be given only in conjunction with configurations and functions different than those of the discharge units according to the previous embodiments.

Figure 13:
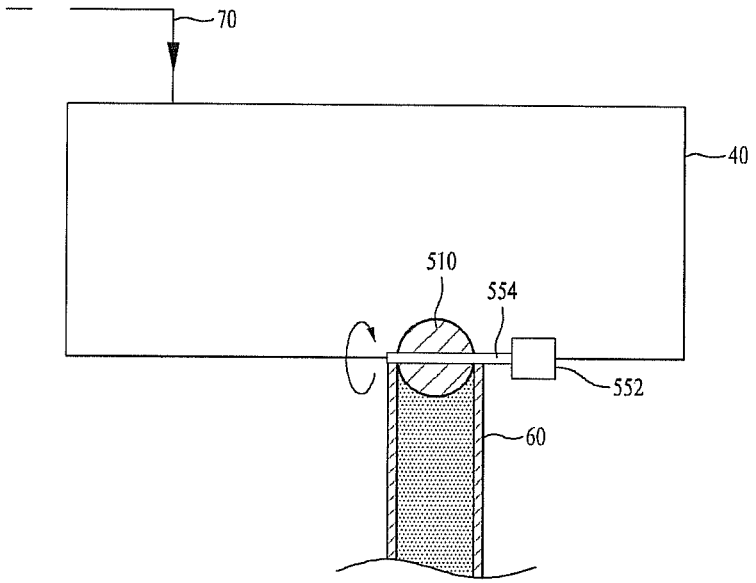
FIGS. 13 and 14 are views illustrating a configuration of the discharged unit in the clothes dryer according to a ninth embodiment of the present invention.

FIG. 13 is a view illustrating a state in which the valve unit 510 is positioned to extend vertically, namely, an opened state of the discharge line 60. FIG. 14 is a view illustrating a state in which the valve unit 510 is positioned to extend horizontally, namely, a closed state of the discharge line 60.

Figure 14:
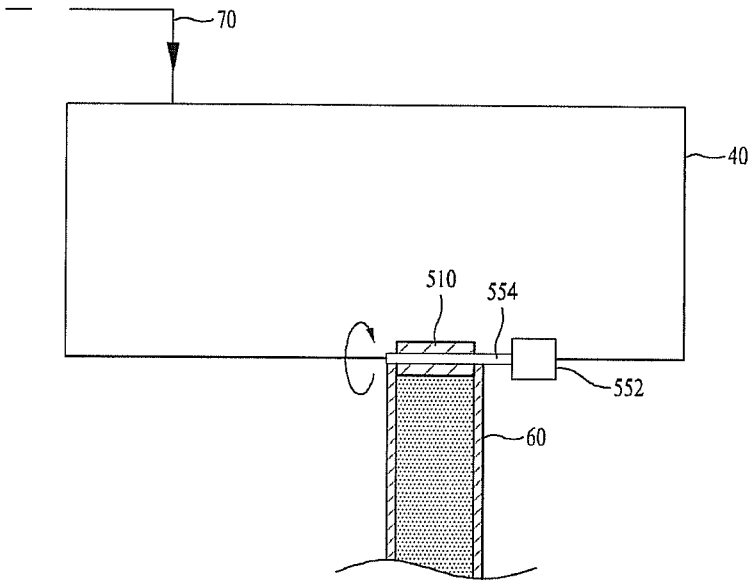

Referring to FIGS. 13 and 14, the discharge unit according to the ninth embodiment includes an actuator including a motor 552 and a rotating shaft 554, and the valve unit 510, which is constituted by a plate coupled to the rotating shaft 554. The plate will be designated by the same reference numeral as the valve unit 510.

The plate 510 has the same cross-sectional shape as the discharge line 60. The size of the plate 510 corresponds to the inner diameter of the discharge line 60. Preferably, a rubber sealing member (not shown) is coupled to an outer peripheral edge of the plate 510, to prevent leakage of condensed water.

Hereinafter, operation of the discharge unit according to the ninth embodiment will be described with reference to FIGS. 13 and 14. When it is desired to discharge condensed water from the water tank 40 by opening the discharge line 60, as shown in FIG. 13, the motor 552 operates to rotate the rotating shaft 554 by a predetermined angle. At this time, the plate 510 coupled to the rotating shaft 554 is also rotated, so that the plate 510 is positioned to extend vertically. Accordingly, condensed water is discharged from the water tank 40 into the discharge line 60 while passing both sides of the plate 510. On the other hand, when the condensed water is completely discharged, the motor 552 again operates to rotate the rotating shaft 554 by a predetermined angle, as shown in FIG. 14. Accordingly, the plate 510 is positioned to extend horizontally. Since the plate 510 has a size corresponding to the inner diameter of the discharge line 60, the discharge line 60 is closed by the plate 510.

Hereinafter, a configuration of the discharge unit according to a tenth embodiment of the present invention will be described with reference to FIGS. 15 and 16.

Figure 15:
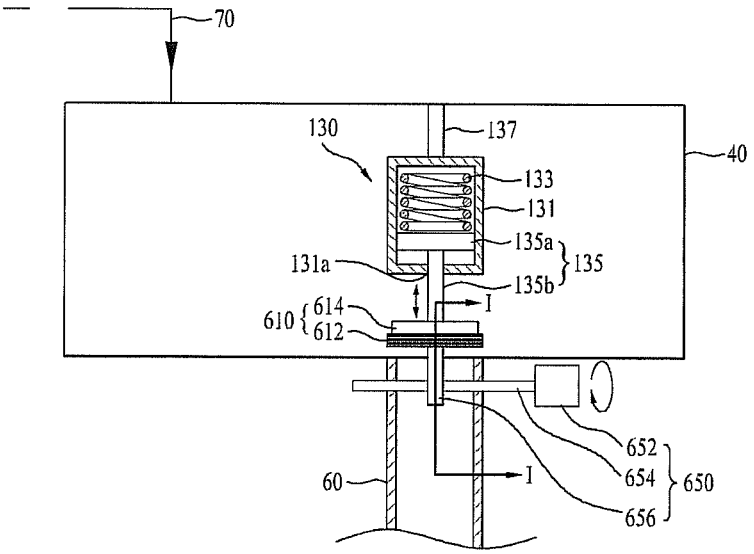
FIG. 15 is a view illustrating a configuration of the discharged unit in the clothes dryer according to a tenth embodiment of the present invention.
Figure 16:
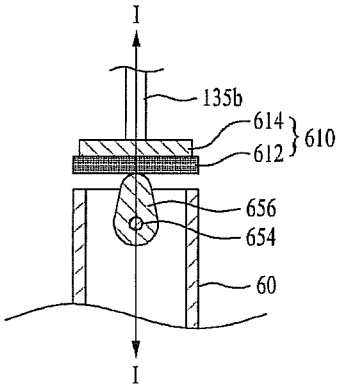
FIG. 16 is a cross-sectional view taken along the line I-I in FIG. 15.

FIG. 15 is a view illustrating the discharge unit of the clothes dryer according to the tenth embodiment of the present invention. FIG. 16 is a cross-sectional view taken along the line I-I in FIG. 15.

The discharge unit of the clothes dryer according to the tenth embodiment of the present invention includes the valve unit 610, the actuator 650, and the return unit 130.

The valve unit 610, which is configured to discharge condensed water from the water tank 40 into the discharge line 60, includes a plug 614 for selectively opening or closing the discharge line 60. The plug 614 may be arranged at a point where the discharge line 60 is connected to the water tank 40. The plug 614 may have a plate shape. Preferably, the plug 614 has a larger diameter than the inner diameter of the discharge line 60. A sealing member 612 may be provided at the plug 614 in order to prevent condensed water from leaking into the discharge line 60 in a state in which the plug 614 closes the discharge line 60.

The actuator 650 functions to upwardly move the valve unit 610, and thus to allow condensed water to be discharged into the discharge line 60. The actuator 650 includes a motor 652, a rotating shaft 654 connected to the motor 652, and a cam 656 disposed within the discharge line 60, to be rotated in accordance with rotation of the rotating shaft 654. A longer portion of the cam 656 selectively comes into contact with a lower surface of the valve unit 610.

Hereinafter, operation of the actuator 650 will be described with reference to FIG. 16. When power is applied to the motor 652, the motor 652 rotates the rotating shaft 654, thereby rotating the cam 656. As the cam 656 rotates, the longer portion of the cam 656 comes into contact with the lower surface of the valve unit 610, thereby upwardly moving the valve unit 610. As the valve unit 610 moves upwardly by the cam 656, the discharge line 60 is opened. Accordingly, condensed water is discharged from the water tank 40 into the opened discharge line 60.

The return unit 130 functions to return the valve unit 610 to an original state thereof. That is, the return unit 130 downwardly moves the valve unit 610, which has been upwardly moved in accordance with operation of the actuator 650. As a result, the opened discharge line 60 is closed.

The return unit 130 includes a housing 131, a connector 135, an elastic member 133, and a support member 137. The housing 131 defines an external appearance of the return unit 130, and accommodates the connector 135 and elastic member 133. The housing 131 has a cylindrical shape. The housing 131 is provided with a hole 131*a* formed through a bottom wall of the housing 131. The connector 135 extends through the hole 131*a*, to be connected to the valve unit 610. In detail, the connector 135 includes a disc 135*a* disposed in the housing 131, to move vertically, and a connecting rod 135*b* for connecting the disc 135*a* to the valve unit 610. The disc 135*a* functions to transmit elastic force from the elastic member 133 to the connecting rod 135*b*. The disc 135*a* is disposed beneath the elastic member 133 within the housing 131. Preferably, the disk 135*a* is designed to have a diameter corresponding to the inner diameter of the housing 131. When the disk 135*a* has a diameter corresponding to the inner diameter of the housing 131, it may be possible to prevent the elastic member 133 from being exposed to condensed water, and thus being corroded. The connecting rod 135*b* connects the disc 135*a* and valve unit 610, to transmit movement between the valve unit 610 and the disc 135*a*. The connecting rod 135*b* is connected at one end thereof to the lower surface of the disc 135*a* while being connected at the other end thereof to an upper surface of the valve unit 610. In addition, one end of the connecting rod 135*b* extends through the hole 131*a* formed at the bottom of the housing 131, to be connected to the lower surface of the disc 135*a*.

The elastic member 133 functions to return the valve unit 610 to an original position when the cam 656 further rotates to be spaced apart from the valve unit 610. For the elastic member 133, any member may be used as long as it has elastic force. Preferably, the elastic member 133 is a coil spring. The elastic member 133 is disposed in the housing 131. In detail, the elastic member 133 is arranged between the inner surface of a top wall of the housing 131 and the disc 135*a*. The elastic member 133 is compressed by the disc 135*a* when the longer portion of the cam 656 comes into contact with the valve unit 610, thereby upwardly moving the valve unit 610. On the other hand, when the cam 656 further rotates to be spaced apart from the valve unit 610, the elastic member 133 returns to an original state thereof while downwardly pressing the disc 135*a*, thereby returning the valve unit 610 to an original position thereof. That is, the compressed elastic member 133 downwardly presses the valve unit 610 while returning to the original state thereof, thereby closing the opened discharge line 60.

The support member 137 functions to fix the housing 131. In order to fix the housing 131, the support member 137 may be coupled to one side of the housing 131. Preferably, the support member 137 is connected at one end thereof to the top wall of the housing 131 while being connected at the other end thereof to the inner surface of a top wall of the water tank 40.

In a condensation type clothes dryer, in particular, the clothes dryer, which is equipped with the heat exchanger 10, air discharged from the drum 1 passes through the heat exchanger 10. In this case, foreign matter, for example, lint, which is separated from clothes, is included in the air discharged from the drum. When the air, which includes the foreign matter, passes through the heat exchanger 10, the foreign matter may adhere to the heat exchanger 10. Where foreign matter or the like adheres to the heat exchanger 10, it interferes with flow of the air passing through the heat exchanger 10. In this case, load is burdened to a circulation fan. In order to solve this problem, the clothes dryer includes a washing device for washing the heat exchanger 10 in accordance with an embodiment of the present invention. Generally, there is no separate water supplier in a clothes dryer, different than a washing machine. In order to wash the heat exchanger 10, as described above, a separate water supplier may be provided at the clothes dryer. In this case, however, there are problems of increased manufacturing costs and complex structure. To this end, the clothes dryer according to the embodiment of the present invention is configured to wash the heat exchanger 10 using condensed water produced in the heat exchanger 10, without including a separate water supplier for supplying wash water to wash the heat exchanger 10.

Figure 17:
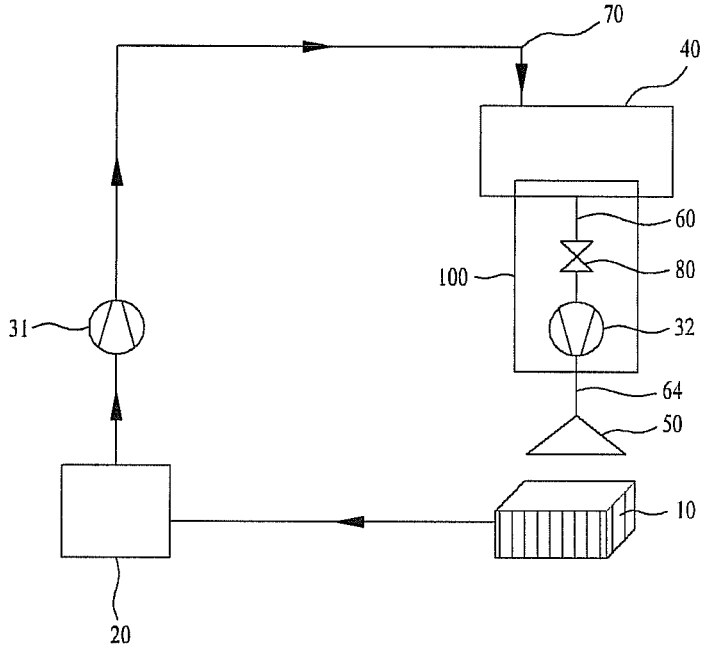
FIG. 17 is a schematic view illustrating a clothes dryer according to another embodiment of the present invention.
Figure 18:
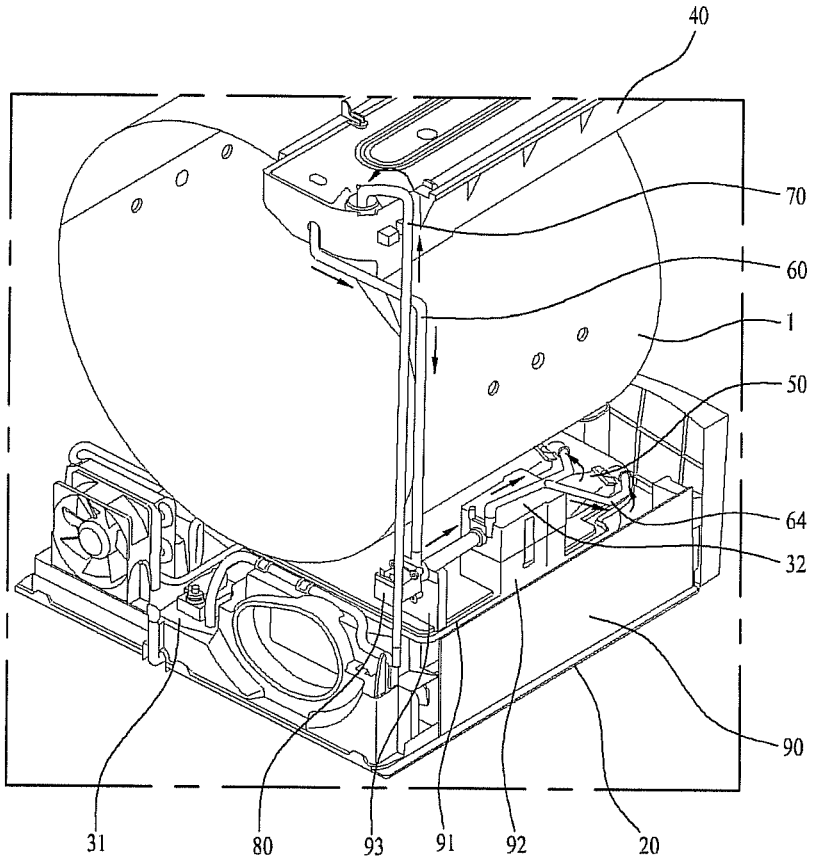
FIG. 18 is a view illustrating an inner configuration of the clothes dryer shown in FIG. 17.

FIG. 17 is a schematic view illustrating a clothes dryer according to another embodiment of the present invention. FIG. 18 is a view illustrating an inner configuration of the clothes dryer shown in FIG. 17.

Referring to FIGS. 17 and 18, the clothes dryer according the illustrated embodiment of the present invention includes a heat exchanger 10 for condensing air discharged from a drum 1 to remove moisture from the air. The clothes dryer also includes a collector 20 for collecting condensed water generated when the air discharged from the drum 1 passes through the heat exchanger 10. The clothes dryer further includes a first pump 31 for pumping the condensed water from the collector 20, and a water tank 40 for storing the pumped condensed water. The clothes dryer further includes a washing device for supplying the condensed water from the water tank 40 to the heat exchanger 10, to wash the heat exchanger 10 by the supplied condensed water. The clothes dryer further includes a discharge unit 100 for discharging the condensed water from the water tank 40 into a discharge line 60, to wash the heat exchanger 10 by the condensed water. The discharge unit 100 may include a second pump 32 and a valve 80.

The heat exchanger 10 may be implemented by devices of various types. Preferably, the heat exchanger 10 is implemented by a heat pump. Dry air introduced into the drum via a circulation duct (not shown) absorbs moisture from an object to be dried, so that it is discharged in a humid state from the drum. The humid air discharged from the drum passes through the heat exchanger 10. At this time, the humid air is condensed to remove moisture therefrom, and then heated. As the humid air passes through the heat exchanger 10, it condensed to remove moisture therefrom, thereby producing dry air. Condensed water produced during condensation of moisture flows downwards from the heat exchanger 10. The condensed water is then collected in the collector 20 disposed beneath the heat exchanger 10. The heat exchanger 10 is arranged at a lower portion of the clothes dryer. In particular, the heat exchanger 10 is disposed within a housing 90. The housing 90, which accommodates the heat exchanger 10, includes a top cover 91, a base, and side covers. The second pump 32 and a washing member 50 are disposed on the top cover 91 of the housing 90.

The first pump 31 pumps the condensed water collected in the collector 20 to the water tank 40 via a supply line 70. The first pump 31 is disposed at a lower portion of the clothes dryer. In detail, the first pump 31 is disposed near the heat exchanger 10. The water tank 40 is disposed at an upper portion of the clothes dryer. The water tank 40 defines a certain space therein to store condensed water. Meanwhile, the first pump 31 and water tank 40 are connected through the supply line 70.

The water tank 40 stores the condensed water pumped by the first pump 31. The amount of condensed water collected in the collector 20 after the clothes dryer operates once is insufficient to wash the heat exchanger 10. To this end, the water tank 40 is provided to reserve a minimum amount of condensed water required to wash the heat exchanger 10 once. The water tank 40 is connected, at a top thereof, to the supply line 70 while being connected, at a bottom thereof, to the discharge line 60. The water tank 40 may be disposed over the heat exchanger 10. Preferably, the water tank 40 is disposed at the upper portion of the clothes dryer.

The washing device includes a washing member 50 for injecting condensed water onto the heat exchanger 10. The second pump 32 pumps condensed water from the water tank 40 to the washing member 50. The second pump 32 is included in the discharge unit 100. The second pump 32 pumps condensed water from the water tank 40 into the discharge line 60, so as to guide the condensed water to the washing member 50. The second pump 32 is disposed over the heat exchanger 60. The water tank 40 and second pump 32 are connected through the discharge line 60. Meanwhile, the valve 80 may be arranged at an intermediate portion of the discharge line 60. The valve 80 selectively opens or closes the discharge line 60. The valve 80 is preferable in the case in which the second pump 32 does not have a configuration capable of selectively cutting off supply of condensed water from the water tank 40 to the washing member 50. When the condensed water in the water tank 40 leaks to the washing member 50 via the second pump 32, the valve 80 may be effectively used. The valve 80 is arranged at the discharge line 60 between the water tank 40 and the second pump 32. Of course, the valve 80 may be arranged over the heat exchanger 10.

The washing member 50 washes the heat exchanger 10 by injecting condensed water onto the heat exchanger 10. Although the washing member 50 may be implemented by members of various types, it may be an injection nozzle in this embodiment. The washing member 50 is connected to the second pump 32 via an injection line 64. The condensed water pumped by the second pump 32 is supplied under high pressure to the washing member 50. The high-pressure condensed water supplied to the washing member 50 is injected onto the heat exchanger 10, thereby washing the heat exchanger 10.

Meanwhile, preferably, a filter unit 700 is provided at the water tank 40, to filter out lint included in condensed water. When air emerging from the drum 1 passes through the heat exchanger 10, lint included in the air adheres to the heat exchanger 10. As lint is gradually accumulated on the heat exchanger 10, it consequently falls into the collector 20. As a result, the condensed water collected in the collector 20 includes lint. When the condensed water, which includes lint, is supplied to the water tank 40 as it is, the discharge line 60, valve 80, or second pump 32 may be chocked or out of order by lint. To this end, the clothes dryer according to the illustrated embodiment of the present invention includes the filter unit 700 arranged at one side of the water tank 40, to filter out lint included in condensed water.

Figure 19:
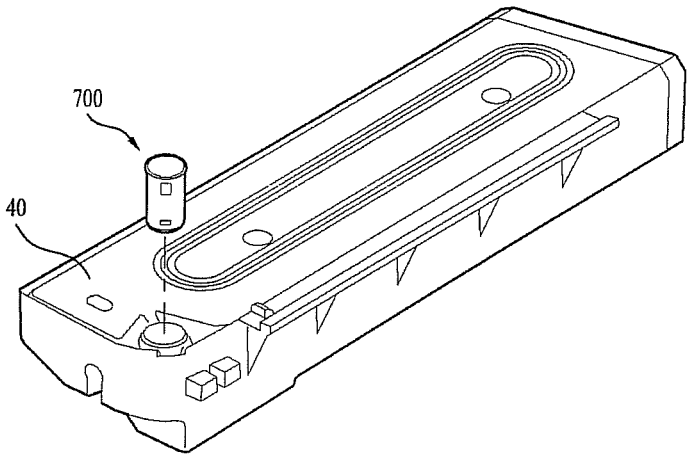
FIG. 19 is an exploded perspective view illustrating coupling between a water tank and a filter unit.

Referring to FIG. 19, the filter unit 700 may be disposed at the top of the water tank 40. Preferably, the filter unit 700 is arranged at a corner of the water tank 40. The filter unit 700 may be separably mounted to the water tank 40. Accordingly, the user 700 cleans the filter unit 700 after separating the filter unit 700 from the water tank 40. The user may clean the filter unit 700 under the condition that the filter 700 is not separated from the water tank 40. That is, when the user inclines the water tank 40 to discharge condensed water from the water tank 40, lint accumulated on the filter unit 700 is removed from the filter unit 700 along with the discharged condensed water.

Figure 20:
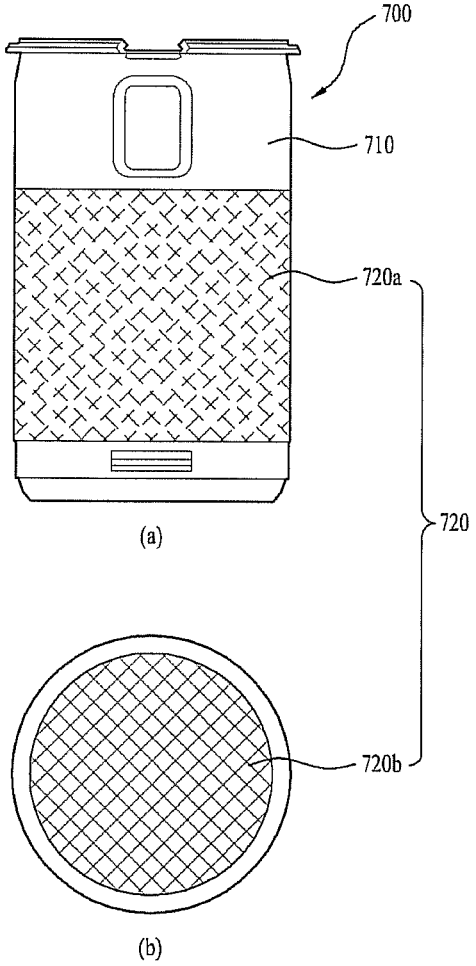
FIG. 20 is a view illustrating the filter unit.

FIG. 20(*a*) is a front view of the filter unit. FIG. 20(*b*) is a bottom view of the filter unit. Referring to FIG. 20, the filter unit 700 includes a body 710 opened at one side thereof, and a filter 720 disposed at the body 710. The body 710 has a cylindrical shape while being upwardly opened. The filter 720 includes a side filter 720*a* disposed around a side portion of the body 710, and a bottom filter 720*b* disposed at a bottom of the body 710. Thus, condensed water supplied to the water tank 40 via the supply line 70 passes through the filter unit 700. At this time, lint included in the condensed water is filtered out by the filter unit 700.

Figure 21:
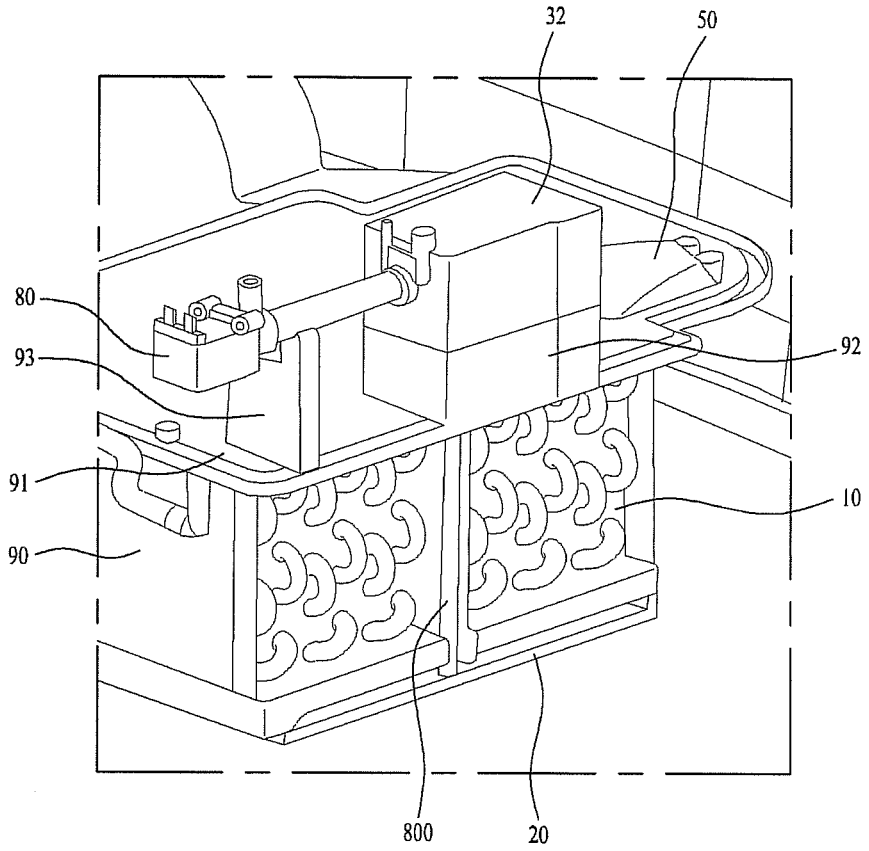
FIG. 21 is a view illustrating a guide line for connecting a second pump and a collector.
Figure 22:
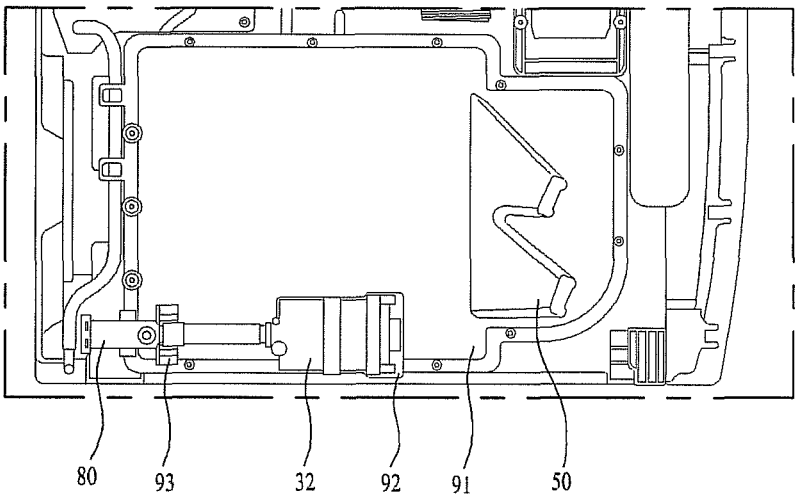
FIG. 22 is a plan view illustrating a top cover included in a housing accommodating a heat exchanger.

Referring to FIGS. 21 and 22, preferably, a valve housing 93 and a second pump housing 92 are disposed on the top cover 91 of the housing 90 in the heat exchanger 10. The valve housing 93 functions to fix the valve 80. The valve housing 93 is disposed on an upper surface of the top cover 91. The second pump housing 92 may have an upwardly-opened box structure. The second pump 32 is fitted through an opened top wall of the second pump housing 92. In accordance with another embodiment of the present invention, the valve housing 93 may be integral with the top cover 91. The second pump housing 92 may also be integral with the top cover 91. The washing member 50 may also be integral with the top cover 91. More preferably, the injection nozzle, which is an example of the washing member 50, is integral with the top cover 91. Thus, in accordance with the above-described embodiment of the present invention, at least one of the valve housing 93, second pump housing 92, and injection nozzle is integral with the top cover 91. The top cover 91 may be made of a plastic or metal material. Where the top cover 91 is made of a plastic material, the valve housing 93, second pump housing 92, and injection nozzle may be formed through an injection molding process, to be integral with the top cover 91. Where at least one of the valve housing 93, second pump housing 92, and injection nozzle is formed to be integral with the top cover 91 in accordance with the above-described embodiment of the present invention, there are advantages in that the manufacturing process is simple, and the manufacturing costs are reduced, as compared to the case in which the above-described constituent elements are separately manufactured.

Meanwhile, when the second pump 32 pumps condensed water from the water tank 40 to the washing member 50, water leakage may occur at an outlet side of the second pump 32. Water leaking at the outlet side of the second pump 32 penetrates into other configurations of the clothes dryer, thereby causing the clothes dryer to be out of order. To this end, the clothes dryer includes a guide line 800 for guiding water leaking from the second pump 32 to the collector 20 in accordance with an embodiment of the present invention.

Figure 23:
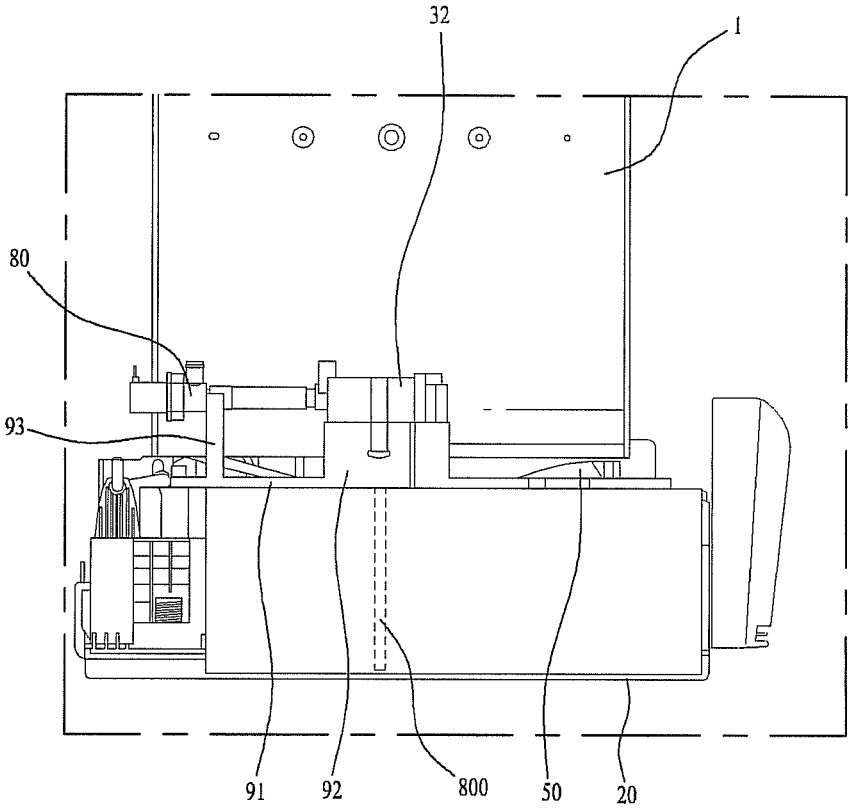
FIG. 23 is a side view illustrating a clothes dryer according to another embodiment of the present invention.

FIG. 21 is a view illustrating the guide line 800 for connecting the second pump 32 to the collector 20. FIG. 23 is a side view illustrating the clothes dryer according to the embodiment shown in FIG. 21.

Referring to FIGS. 21 and 23, the guide lien 800 connects the second pump 32 and collector 20. In detail, the guide line 800 is arranged beneath the second pump 32. The guide line 800 extends through the heat exchanger 10. The guide line 800 has an end communicating with the collector 20. When water leakage occurs at the outlet side of the second pump 32, the leaked condensed water is collected in the second pump housing 92. The condensed water collected in the second pump housing 92 is then guided to the guide line 800 communicating with the second pump housing 92. Thus, the leaked condensed water is drained to the collector 20 along the guide line 800. By the provision of the guide line 800, accordingly, it may be possible to prevent other configurations of the clothes dryer from being out of order due to water leakage occurring at the outlet side of the second pump 32.

As apparent from the above description, in accordance with embodiments of the present invention, there are advantages in that the structure of the discharge unit of the water tank is simple and efficient because the discharge line of the water tank is selectively opened or closed using a solenoid switch, electromagnet or motor.

In accordance with embodiments of the present invention, there are advantages in that the clothes dryer does not use a separate water supplier required to wash the heat exchanger because the heat exchanger is washed using condensed water produced in the heat exchanger.

Also, since the filter unit is provided at the water tank, there are advantages in that it may be possible to prevent the discharge line, valve unit, valve or second pump from being chocked or out of order by lint when condensed water, which includes the lint, is supplied to the water tank.

Since at least one of the valve housing, pump housing, and injection nozzle is formed to be integral with the top cover of the housing in the heat exchanger, there are advantages in that the manufacturing process is simple, and the manufacturing costs are reduced, as compared to the case in which the above-described constituent elements are separately manufactured.

In addition, since the guide line is provided to guide condensed water leaking at the outlet side of the pump to the condensed water collector, there is an effect capable of preventing other configurations of the clothes dryer from being out of order due to water leakage.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dryer, comprising:

a drum to accommodate an object to be dried;

a housing provided under the drum, the housing having a top cover and a base;

a heat exchanger in the housing, and the heat exchanger is configured to condense air from a drum;

a collector provided under the heat exchanger in the housing, and the collector is configured to collect condensed water from the heat exchanger;

a first pump to provide the condensed water from the collector to a tank;

a second pump disposed on the top cover of the housing, and the second pump to provide the condensed water from the tank to the heat exchanger;

a guide line arranged beneath the second pump and configured to connect the second pump to the collector so as to guide water leaking from the second pump to the collector, the guide line extending through the heat exchanger;

a discharge line to couple between the water tank and the second pump, and the condensed water to pass through the discharge line;

a valve at the discharge line between the water tank and the second pump for selectively opening and closing the discharge line; and a washing member to couple to the second pump via an injection line, the washing member is provided at the top cover of the housing, and the washing member to provide the condensed water to the heat exchanger in the housing.

2. The dryer according to claim 1, further comprising a valve housing configured to fix a position of the valve and a second pump housing configured to fix a position of the second pump, wherein the valve housing and the second pump housing are disposed on the top cover of the housing of the heat exchanger.

3. The dryer according to claim 2, wherein at least one of the valve housing, the second pump housing or the washing device is formed integrally with the top cover.

4. The dryer according to claim 1, wherein the washing member includes an injection nozzle.

5. The dryer according to claim 1, wherein the guide line has an end portion to communicate with the collector.

6. A dryer, comprising:

a drum to accommodate an object to be dried;

a housing provided under the drum, the housing including a top cover, a base, and side covers;

a heat exchanger provided in the housing, and the heat exchanger is configured to condense air discharged from a drum to remove moisture from the air;

a collector provided under the heat exchanger in the housing, and the collector is configured to collect condensed water produced in the heat exchanger;

a first pump configured to pump the condensed water from the collector to a tank;

a second pump disposed on the top cover of the housing and configured to supply the condensed water from the tank to the heat exchanger, to wash the heat exchanger using the supplied condensed water;

a guide line arranged beneath the second pump and configured to connect the second pump to the collector so as to guide water leaking from the second pump to the collector, the guide line extending through the heat exchanger;

a discharge line configured to connect the water tank and the second pump and to discharge the condensed water;

a valve provided in the discharge line between the water tank and the second pump for selectively opening and closing the discharge line; and a washing member connected to the second pump via an injection line, the washing member disposed on the top cover of the housing and configured to inject the condensed water into the housing onto the heat exchanger.

7. The dryer according to claim 6, further comprising a valve housing configured to fix a position of the valve and a second pump housing configured to fix a position of the second pump, wherein the valve housing and the second pump housing are disposed on the top cover of the housing of the heat exchanger.

8. The dryer according to claim 6, wherein the washing member includes an injection nozzle.

9. The dryer according to claim 7, wherein at least one of the valve housing, the second pump housing or the washing device is formed integrally with the top cover.

10. The dryer according to claim 6, wherein the guide line has an end portion communicating with the collector.

* * * * *